US007335018B2

(12) United States Patent
Yamaguchi

(10) Patent No.: US 7,335,018 B2
(45) Date of Patent: Feb. 26, 2008

(54) FLAME RESISTANT RENDERING HEAT TREATING DEVICE, AND OPERATION METHOD FOR THE DEVICE

(75) Inventor: Masanao Yamaguchi, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 662 days.

(21) Appl. No.: 10/276,331

(22) PCT Filed: Mar. 20, 2002

(86) PCT No.: PCT/JP02/02720

§ 371 (c)(1),
(2), (4) Date: Nov. 10, 2003

(87) PCT Pub. No.: WO02/077337

PCT Pub. Date: Oct. 3, 2002

(65) Prior Publication Data

US 2005/0115103 A1 Jun. 2, 2005

(30) Foreign Application Priority Data

Mar. 26, 2001 (JP) ..... 2001-86618
Sep. 27, 2001 (JP) ..... 2001-296227

(51) Int. Cl.
*F27B 9/28* (2006.01)

(52) U.S. Cl. ..... 432/59; 432/8

(58) Field of Classification Search ..... 432/8, 432/59; 219/469

See application file for complete search history.

(56) References Cited

U.S. PATENT DOCUMENTS 4,545,762 A 10/1985 Arita et al.
4,559,010 A 12/1985 Katsuki et al.
5,908,290 A * 6/1999 Kawamura et al. ..... 432/59
6,027,337 A * 2/2000 Rogers et al. ..... 432/64
6,776,611 B1 * 8/2004 Sprague ..... 432/64
7,004,753 B2 * 2/2006 Stockhausen ..... 432/59

FOREIGN PATENT DOCUMENTS

JP 62-228867 10/1987
JP 10-237723 9/1998

* cited by examiner

*Primary Examiner*—Gregory Wilson
(74) *Attorney, Agent, or Firm*—Oblon, Spivak, McClelland, Maier & Neustadt, P.C.

(57) ABSTRACT

A heat treatment apparatus for oxidation having an oven for oxidation having a heat treatment chamber having a plurality of slits through which fiber strands running horizontally leave or returned strands enter and capable of sending hot air vertically from above the fiber strands to allow the fiber strands to have oxidation, and a device for feeding hot air into the heat treatment chamber, and a plurality of returning rollers which are provided at the two outsides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and each channeling-preventing plate interposed between the side wall and the fiber strands in parallel to the running direction of fiber strands is set at 150 mm or less. The slits may be provided with a device for injecting hot air into the heat treatment chamber.

16 Claims, 7 Drawing Sheets

FLAME RESISTANT RENDERING HEAT TREATING DEVICE, AND OPERATION METHOD FOR THE DEVICE

TECHNICAL FIELD

The present invention relates to a heat treatment apparatus for oxidation, used in production of polyacrylonitrile-based oxidation fiber (flame-resistant fiber). More particularly, the present invention relates to an apparatus used for subjecting polyacrylonitrile-based fiber strands or the like to a heat treatment for oxidation, as well as to an operating method of tile apparatus. The oxidation fiber is important as a heat-resistant fiber or as a material for production of polyacrylonitrile-based carbon fiber.

BACKGROUND ART

Polyacrylonitrile-based oxidation fibers have been produced by subjecting a polyacrylonitrile-based fiber to a heat treatment for oxidation in an oxidizing atmosphere of 200 to 300° C.

The reaction taking place in the heat treatment of polyacrylonitrile-based fiber for oxidation is an exothermic reaction wherein oxidation and cyclization take place simultaneously. A heat treatment at a high temperature results in a high reaction rate and a short treatment time. When the heart treatment for oxidation is conducted rapidly, however, the heat generated in the oxidation reaction is accumulated in the fiber and the fiber-inside temperature increases. As a result, an uncontrollable reaction which is accompanied by yarn breakage and firing, tends to be invited.

Further, the heat treatment for oxidation is ordinarily conducted for strands which are each formed as a bundle of a large number of fibers. When a large number of strands are simultaneously subjected to the heat treatment for oxidation for higher production efficiency, it is impossible to obtain oxidation fiber strands at a high temperature in a short time without efficiently removing the generated reaction heat from the fibers, because heat accumulates easily in the strands.

Since the time required for heat treatment for oxidation is long and the energy required therefor is very large, a further improvement in productivity is needed in the step of heat treatment for oxidation.

FIG. 10 is a schematic drawing showing a conventional heat treatment apparatus for oxidation. (A) is a front section, (B) is a side section, and (C) is a top section.

In FIG. 10(A), 52 is a heat treatment apparatus for oxidation. In a heat treatment chamber 54 thereof run plural steps of paths 57*a*, 57*b*, 57*c*, . . . 57*x* each formed by a large number of strands 56 arranged horizontally. As shown in FIG. 10(B), the strands 56 are returned by given sets of returning rollers 58 provided outside the heat treatment chamber 54 and are fed into the heat treatment chamber 54 repeatedly.

As shown in FIG. 10(B), the strands 56 forming the plural steps of paths leave and enter the heat treatment chamber 54 through the slits 64*a*, 66*a*, 66*b* and 64*b* respectively formed in the outer wall 60*a*, inner wall 62*a*, inner wall 62*b* and outer wall 60*b* of the heat treatment apparatus for oxidation.

As shown in FIG. 10(C), inner side walls 68*a* and 68*b* are formed at the both sides of heat treatment chamber 54.

In the left half of the heat treatment chamber 54, an outer side wall 69*a* is formed outside the inner side wall 68*a*, and a hot air circulation duct 74*a* is formed between the inner side wall 68*a* and the outer side wall 69*a*. As shown in FIG. 10(A), the hot air circulation duct 74*a* connects an upper duct 70 and a lower duct 72 both of the heat treatment chamber 54.

A heater 76*a* provided in the hot air circulation duct 74*a* generates hot air, and the hot air is sent into the upper duct 70 by a fan 78*a* and further into the heat treatment chamber 54. Then, the hot air passes between the strands 56 running in a path state and is sent downward. At this time, the strands are heat-treated for oxidation. Incidentally, the hot air heats the strands and also has the role of heat removal.

Then, the hot air passes through the lower duct 72 and is sent into the hot air circulation duct 74*a*. The hot air is heated therein by the heater 76*a*. This operation is repeated.

In the left half of the heat treatment chamber 54 shown in FIG. 10(C), an outer side wall 69*b* is formed outside the inner side wall 68*b*. Between the inner side wall 68*b* and the outer side wall 69*b* is formed a heat-insulating air chamber 80*a*.

Meanwhile, the right half of the heat treatment chamber 54 shown in FIG. 10(C) is formed skew-symmetrically to the left half. That is, between the inner side wall 68*a* and the outer side wall 69*a* is formed a heat-insulating air chamber 80*b*. Similarly, between the inner side wall 68*b* and the outer side wall 69*b* is formed a hot air circulation duct 74*b* connecting the upper duct 70 and the lower duct 72 both of the heat treatment chamber 54. 76*b* is a heater and 78*b* is a fan.

This heat treatment apparatus is covered, at the circumference, with a heat-insulating material for an enhanced heat efficiency.

Even in such a heat-insulating structure, the temperature, for example, in the vicinity of the inner side walls 68*a* and 68*b* of the heat treatment chamber 54 is lower than the average temperature inside the heat treatment chamber 54. As a result, the rate of heat treatment for oxidation, of the strands near the inner walls 68*a* and 68*b* is low and the heat treatment of strands for oxidation do not take place uniformly. In order to avoid this problem, strands 56 are ordinarily allowed to run about 200 mm apart from the side walls 68*a* and 68*b* in ordinary heat treatment apparatuses for oxidation.

Meanwhile, in the heat treatment chamber 54, a large number of strands 56 forming paths may be allowed to run in one zone wherein the strands 56 are arranged uniformly. However, running of paths in a plurality of zones [two zones 59*a* and 59*b* in FIG. 10(A)] in place of one zone, with a given gap X taken between two neighboring zones allows easier handling.

For example, when strands forming paths are allowed to run in one zone and when troubles such as fiber breakage and the like occur, the broken piece of fiber coils around a nearby strand, resulting in worsening of trouble and possible spread of the damage to the whole strands. Further, manual operation may be needed for the troubled strands. For these reasons, it is preferred to divide paths into a plurality of zones with a given gap taken between two neighboring zones.

Therefore, in ordinary heat treatment apparatuses for oxidation, strands 56 forming paths are divided into a plurality of zones, the gap between the inner side wall and paths is kept at about 200 mm, a gap of about 200 mm is taken between two neighboring zones, and a heat treatment of strands for oxidation is conducted.

When, in the above heat treatment apparatus for oxidation, strands running in a state of horizontal plural steps of paths arranged vertically are heat-treated for oxidation in the heat treatment chamber, if the number of strands in the heat treatment chamber is increased for higher productivity, hot air receives an increased resistance and the speed of hot air passing through paths is reduced significantly. Resultantly, the strands undergo insufficient cooling. As a result, heat is generated in the strands and, moreover, breakage of fiber due to generated heat occurs. Further, the broken fiber coils around the fiber of other strand, resulting in worsening of trouble. Incidentally, this problem in heat treatment of polyacrylonitrile-based fiber for oxidation may develop into fire being generated. Because of the occurrence of such a serious problem, significant improvement in productivity of oxidation fiber has heretofore been impossible.

DISCLOSURE OF THE INVENTION

The present inventor considered that the reduction in speed of hot air during its passing through strand paths is caused by the concentration of hot air in between paths and inner side wall and between zones. The speed of hot air passing through paths tends to decrease significantly in lower paths, in particular, and the breakage of fiber occurs frequently in these lower paths.

In order to prevent such fiber breakage, a countermeasure such as lowering the inside temperature or the like of heat treatment chamber is necessary. The lowering inside temperature of heat treatment chamber, however, results in lower reaction rate and consequently in lower productivity, which is contrary to intended productivity improvement.

Further, in subjecting strands to a heat treatment for oxidation using the above heat treatment apparatus for oxidation, there is a problem in that hot air leaks from the slits formed for leaving and entering of strands from and into the heat treatment chamber.

According to an experience, when the speed of hot air passing through the uppermost strand path located at the upstream of hot air is, for example, 1.8 m/sec, the speed of hot air passing through intermediate strand paths located at the downstream of hot air may drop to 0.3 m/sec. In such a case, it is considered that in lower paths, the reaction heat generated by the oxidation of strands tends to be removed less by hot air.

Further, the reaction heat generated by the strands of upper paths located at the upstream of hot air is carried by hot air to the downstream of hot air. Hence, it was considered that the strands of lower paths causes heat build-up and reach a high temperature, making impossible uniform heat treatment for oxidation. In such a case, it is possible that lower strands give rise to an uncontrollable reaction and firing.

SUMMARY OF THE INVENTION

The present invention has been completed based on the above considerations.

Hence, the present invention aims at providing a heat treatment apparatus for oxidation which can uniformly conduct a heat treatment of strands for oxidation and which can give improved productivity without quality deterioration, and an operating method of the apparatus.

The present invention which achieves the above aim, lies in the following.

[1] A heat treatment apparatus for oxidation having:

an oven for oxidation having a heat treatment chamber having a plurality of slits through which fiber strands running horizontally leave or returned strands enter and capable of sending hot air vertically from above the fiber strands to allow the fiber strands to have oxidation, and a means for feeding hot air into the heat treatment chamber, and a plurality of returning rollers which are provided at the two outsides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and each channeling-preventing plate interposed between the side wall and the fiber strands in parallel to the running direction of fiber strands is set at 150 mm or less.

[2] A heat treatment apparatus for oxidation according to the above [1], wherein the channeling-preventing plate has air-passing holes.

[3] A heat treatment apparatus for oxidation according to the above [1], wherein the oven for oxidation comprises:

a heat treatment chamber wherein hot air passes from the above toward the bottom, an upper duct formed at the top of the heat treatment chamber, a lower duct formed at the bottom of the heat treatment chamber, and a hot air circulation duct connecting the upper duct and the lower duct.

[4] A heat treatment apparatus for oxidation according to the above [3], wherein an air rate-controlling member is provided in the hot air circulation duct.

[5] A heat treatment apparatus for oxidation according to the above [3], wherein hot air circulation means are provided at the top and bottom of the hot air circulation duct.

[6] A heat treatment apparatus for oxidation according to the above [5], wherein each hot air-circulation means is a fan or a blower.

[7] A heat treatment apparatus for oxidation according to the above [6], wherein the blower is a multi-blade blower having two inlets for hot air.

[8] A heat treatment apparatus for oxidation according to the above [1], wherein air-passing members having an opening ratio of 50% or more are provided above lower air-passing plates provided at the bottom of the heat treatment chamber and apart from the lower air-passing plates by 20 mm or more.

[9] A heat treatment apparatus for oxidation having:

an oven for oxidation having a heat treatment chamber having a plurality of slits through which fiber strands running horizontally leave or returned strands enter and capable of sending hot air vertically from above the fiber strands to allow the fiber strands to have oxidation, and a means for feeding hot air into the heat treatment chamber, and a plurality of returning rollers which are provided at the two outsides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and each channeling-preventing plate interposed between the side wall and the fiber strands in parallel to the running direction of fiber strands is set at 150 mm or less and a heating means is provided at the side walls or in the slits.

[10] A heat treatment apparatus for oxidation according to the above-noted item [9], wherein the heating means is a hot air duct formed outside each side wall of the heat treatment chamber.

[11] A heat treatment apparatus for oxidation according to the above-noted item [9], wherein the heating means is a heater formed each side wall of the heat treatment chamber.

[12] A heat treatment apparatus for oxidation according to the above [9], wherein the heating means is nozzles for feeding hot air into the heat treatment chamber, provided in all or part of the plurality of slits.

[13] A heat treatment apparatus for oxidation according to the above-noted item [12], wherein the hot air has a temperature higher than the temperature of the heat treatment chamber.

[14] A heat treatment apparatus for oxidation according to the above-noted item [12], wherein the nozzles have a mechanism of feeding, into the heat treatment chamber, not only the hot air injected from the nozzles but also the air present in the vicinity of each nozzle and drawn by said hot air.

[15] A heat treatment apparatus for oxidation according to the above-noted item [12], wherein the nozzles are provided only in the slits through which each fiber strand enters the heat treatment chamber.

[16] A heat treatment apparatus for oxidation according to the above-noted item [12], wherein at least one of lower slits corresponding to 70% of the total slits has a nozzle capable of injecting air outside the heat treatment chamber.

[17] An operating method of a heat treatment apparatus for oxidation having:

an oven for oxidation having a heat treatment chamber having a plurality of slits through which fiber strands running horizontally leave or returned strands enter and capable of sending hot air vertically from above the fiber strands to allow the fiber strands to have oxidation, and means for feeding hot air into the heat treatment chamber, and a plurality of returning rollers which are provided at the two sides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and each channeling-preventing plate interposed between the side wall and the fiber strands in parallel to the running direction of fiber strands is set at 150 mm or less and the plurality of slits are each provided with a nozzle capable of injecting hot air inside the oven for oxidation, in which the operating method the speed of the hot air fed from the nozzles is controlled and thereby the speed of the hot air passing through the fiber strands other than the uppermost fiber strands is kept at 20% or more of the speed of the hot air passing through the uppermost fiber strands.

DESCRIPTION OF THE PREFERRED EMBODIMENTS

Figure 1:
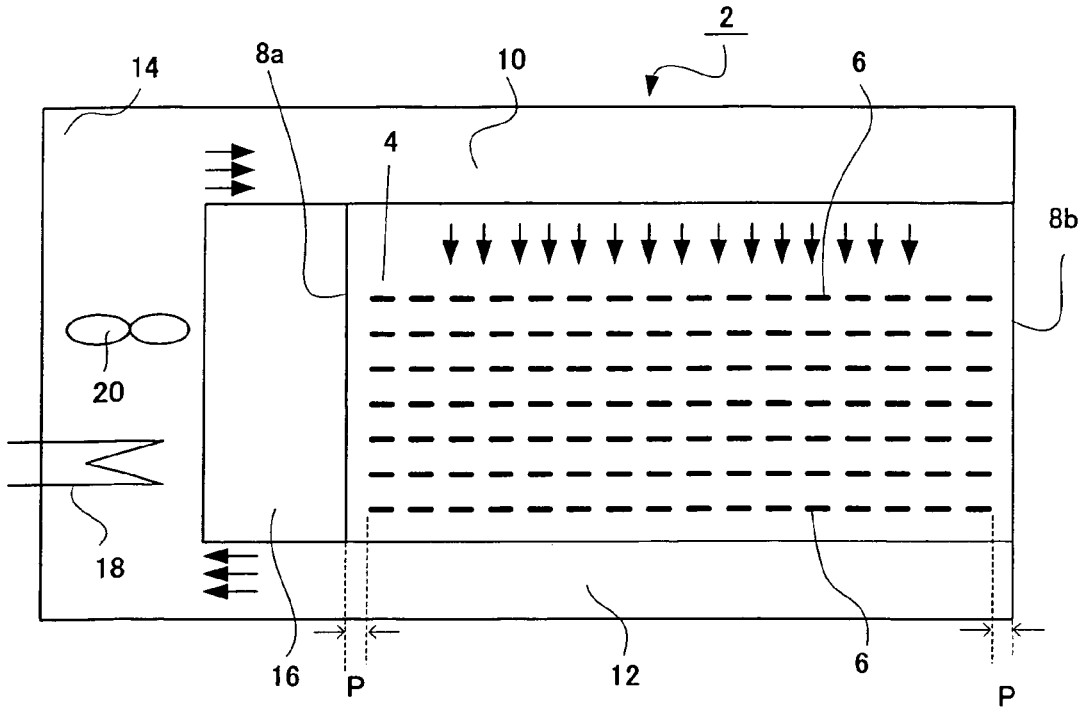
FIGS. 1 to 4 are each a schematic front sectional view showing an example of the heat treatment apparatus for oxidation according to the present invention.

The present invention includes a heat treatment apparatus 2 for oxidation; a heat treatment chamber 4; a strand 6; side walls 8*a*, 8*b* an upper hot air duct 10; a lower hot air duct 12; a hot air circulation duct 14; a space 16; a heater 18; a fan 20; a gap P; a heat treatment chamber 22; inner side walls 24*a*, 24*b*; hot air ducts 26*a*, 26*b*; a heat treatment apparatus 28 for oxidation; outer side walls 30*a*, 30*b*; a strand 32; a heat treatment apparatus 48 for oxidation; side walls 44*a*, 44*b*; heating means 46*a*, 46*b*; a strand 50; a path 500; zones 510, 512; a distance L; a distance M; a distance N; an oven 102 for oxidation; a front outer wall 104*a*; a front inner wall 106*a*; a back inner wall 106*b*; a back outer wall 104*b*; slits 108*a*, 108*b*; a left outer side wall 112*a*; a left inner side wall 114*a*; a right inner side wall 114*b*; a right outer side wall 112*b*; an upper outer wall 116*a*; a lower outer wall 116*b*; an upper air-passing plate 118*a*; a lower air-passing plate 118*b*; a heat treatment chamber 120; an upper duct 122; a lower duct 124; a front half H; hot air circulation ducts 126*a*, 126*b*; heat-insulating air chambers 128*a*, 128*b*; a back half I; a strand 130; returning rollers 132*a*, 132*b*; a distance R; a distance S; a distance T; a channeling-preventing plate 138*a*; a channeling-preventing plate 138*b*; a channeling-preventing plate 138*c*; a hot air circulation means 142*a*; a hot air circulation means 142*c*; an air speed-controlling member 140*a*, 140*b*; an air-passing member 144; a heat treatment chamber wall 202; an outer wall 204; an inner wall 206; a slit 208; a strand 210; an upper hot air duct 212; an lower hot air duct 214; an upper nozzle 216; a lower nozzle 218; an angle of intersection θ; an air speed controlling plate 220, 222; heat treatment chamber walls 302, 402; slits 308, 408; upper nozzles 316, 416; and lower nozzles 318, 418.

BEST MODE FOR CARRYING OUT THE INVENTION (First Mode)

The present invention is described in detail below with reference to FIGS. 1 to 3.

FIG. 1 is a schematic front sectional view showing an example of the heat treatment apparatus for oxidation according to the present invention.

In FIG. 1, 2 is a heat treatment apparatus for oxidation wherein a heat treatment chamber 4 is formed therein and a large number of strands 6 are running in the heat treatment chamber 4. (In FIG. 1, the running direction of strands is vertical to the paper surface.) The strands 6 are parallel to each other and form a plurality of horizontal paths (seven paths in FIG. 1). These paths are arranged from upward to downward apart from each other by a given distance. The strands 6 forming the paths are returned by given pairs of returning rollers (not shown in FIG. 1) provided outside the heat treatment chamber 4, and are fed into the heat treatment chamber 4 repeatedly.

Side walls 8*a* and 8*b* of the heat treatment chamber 4 are parallel to the running direction of the strands 6. Outside the side wall 8*a* is formed a hot air circulation duct 14. Between the side wall 8*a* and the hot air circulation duct 14 is formed a space 16. An upper hot air duct 10 and a lower hot air duct 12 both of the heat treatment chamber 4 are connected by the hot air circulation channel 14. The upper hot air duct 10, the lower hot air duct 12 and the hot air circulation duct 14 constitute a hot air-feeding means.

A heater 18 is provided in the hot air circulation duct 14. Hot air heated by the heater 14 is passed, by a fan 20, through the upper hot air duct 10 of the heat treatment chamber 4, sent into the heat treatment chamber 4, and flows down in the heat treatment chamber 4. At that time, the strands 6 running in a state of the above-mentioned paths are heat-treated for oxidation. Then, the hot air is passed through the lower hot air duct 12, sent to the bottom of the hot air circulation duct 14, and is returned to the heater 18. This operation is repeated.

In the heat treatment chamber 4 of the heat treatment apparatus for oxidation, a gap P between side wall 8*a* or 8*b* and strand at end of path is set to be 150 mm or less, preferably at 50 mm or less, more preferably at 5 to 20 mm. By thus setting the P at 150 mm or less, concentration of hot air in each gap between path and side wall can be prevented. Since the hot air passes over the path surfaces uniformly, the reduction in hot air speed which has heretofore arisen as the hot air moves from upper paths toward lower paths, can be minimized.

Figure 2:
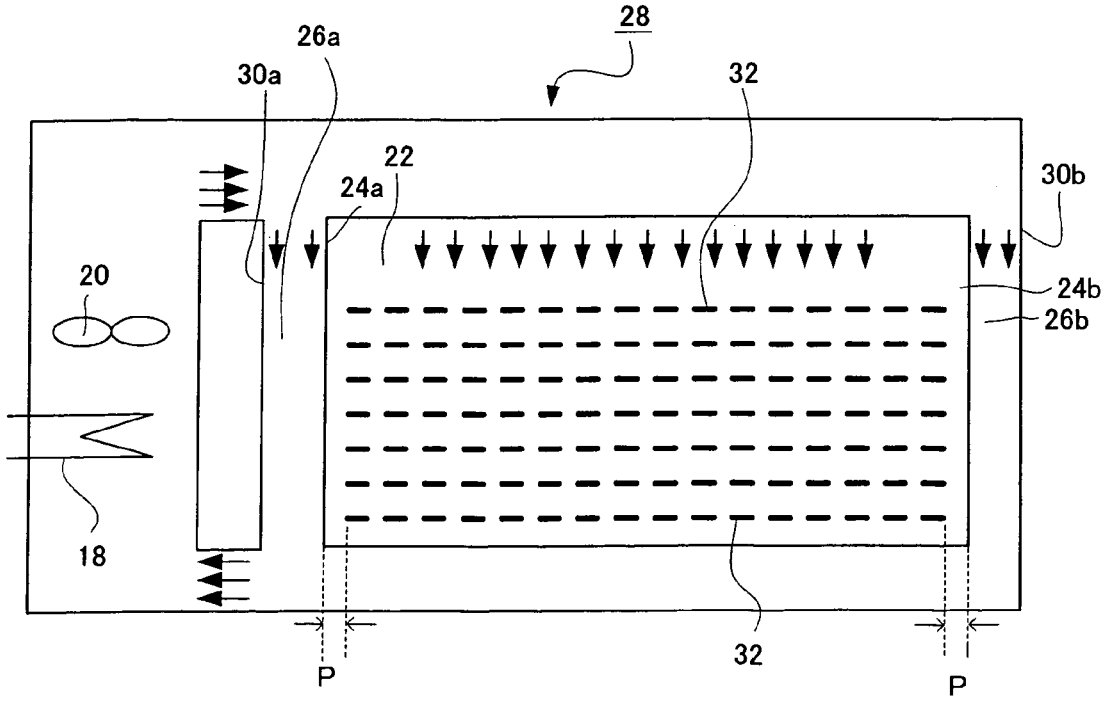

FIG. 2 shows other example of the heat treatment apparatus for oxidation according to the present invention. In this heat treatment apparatus 28 for oxidation, outer side walls 30*a* and 30*b* are added respectively outside of inner side walls 24*a* and 24*b* of a heat treatment chamber 22. Between the inner side wall 24*a* and the outer side wall 30*a* and between the inner side wall 24*b* and the outer side wall 30*b* are formed hot air ducts 26*a* and 26*b* as a side wall-heating means for prevention of side wall temperature reduction. Further, a gap P between inner side wall 24*a* or 24*b* and strand at end of path is set at 150 mm or less, preferably at 50 mm or less, more preferably at 5 to 20 mm. Other constitution is the same as in the heat treatment apparatus for oxidation shown in FIG. 1.

In the heat treatment apparatus 28 for fame resistance shown in FIG. 2, the temperature reduction of the side walls 24*a* and 24*b* can be prevented because the hot air ducts 26*a* and 26*b* are provided as a side wall-heating means.

Incidentally, the gap between side walls of double structure, i.e. each width of hot air ducts 26*a* and 26*b* is not critical but is preferred to be ordinarily 100 to 200 mm.

In the heat treatment apparatus 28 for oxidation, strands 32 running in the heat treatment chamber 22 receive thermal load uniformly; there is sufficient heat removal over the entire paths; and the productivity of oxidation fiber can be made high.

Figure 3:
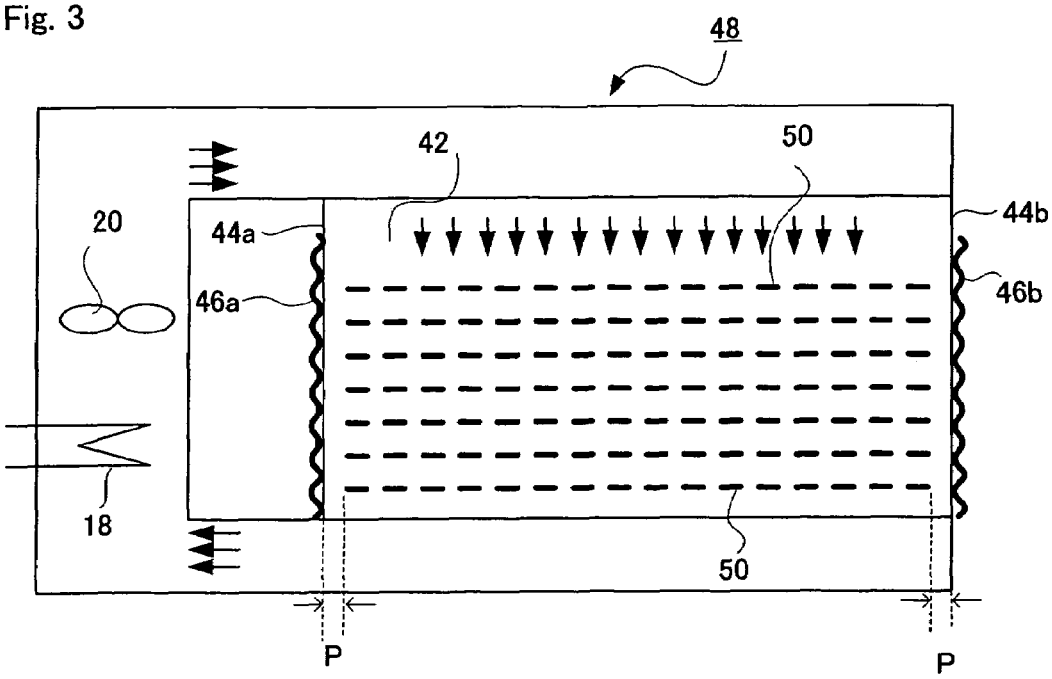

FIG. 3 shows still other example of the heat treatment apparatus for oxidation according to the present invention.

This heat treatment apparatus 48 for oxidation is provided with heating means 46*a* and 46*b* outside side walls 44*a* and 44*b*. The heating means are not critical and can be exemplified by an electric heater and a steam heater. By the heating means, the difference between the heat treatment chamber temperature and side wall temperature can be set at 10° C. or less. Further, a gap P between side wall 44*a* or 44*b* and strand 50 at end of path is set at 150 mm or less, preferably at 50 mm or less, more preferably at 5 to 20 mm.

Other constitutions are the same as in the heat treatment apparatuses for oxidation, shown in FIGS. 1 and 2.

Owing to the heating means 46*a* and 46*b*, the difference between heat treatment chamber temperature and side wall temperature can be made small (10° C. or less) and the temperature reduction of strand 50 at each end of path can be prevented.

Each of the above heat treatment apparatuses for oxidation is constituted so that the gap P between side wall and strand constituting path become 150 mm or less; therefore, there is no concentration of hot air in the gap P. Since hot air passes between strands uniformly over the entire paths, the reduction in hot air speed from upper paths to lower paths can be prevented.

Figure 4:
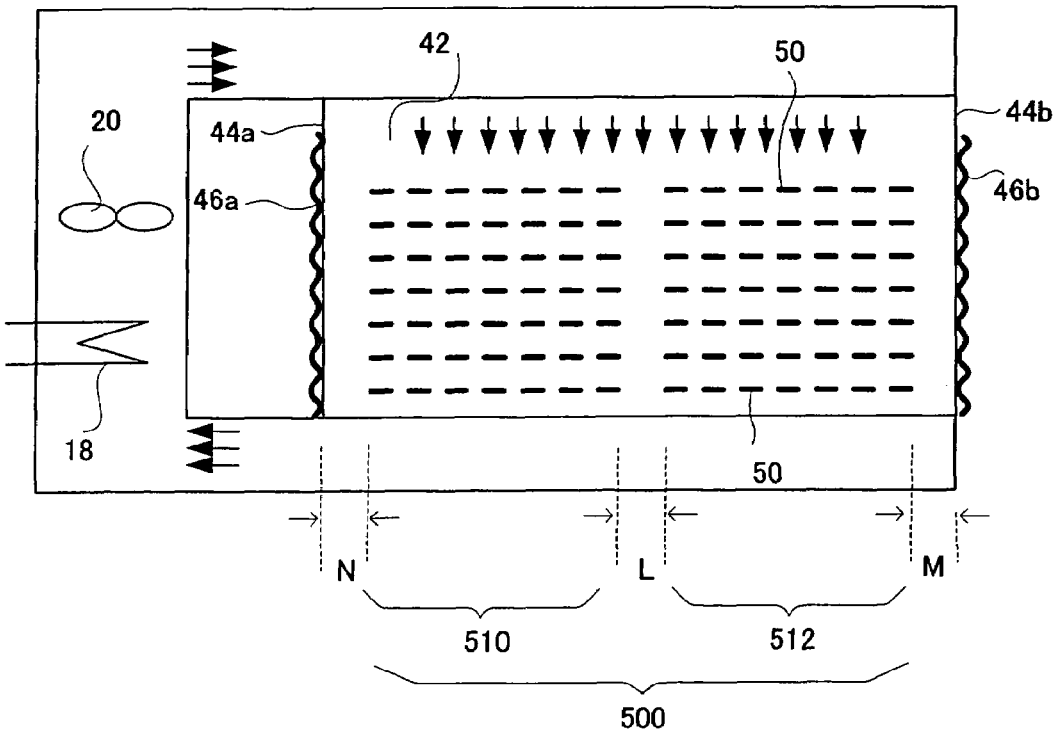

The above description on each heat treatment apparatus for oxidation was made on a case wherein paths are not divided into a plurality of zones. When, as shown in FIG. 4, paths 500 are divided into a plurality of zones (two zones 510 and 512 in FIG. 4), the distance between zones (L in FIG. 4) and the distances between zone and side wall (M and N in FIG. 4) are each set at 150 mm or less, preferably at 50 mm or less, and more preferably at 5 to 20 mm.

(Second Mode)

The present invention is described in detail below with reference to FIGS. 5 to 9.

Figure 5:
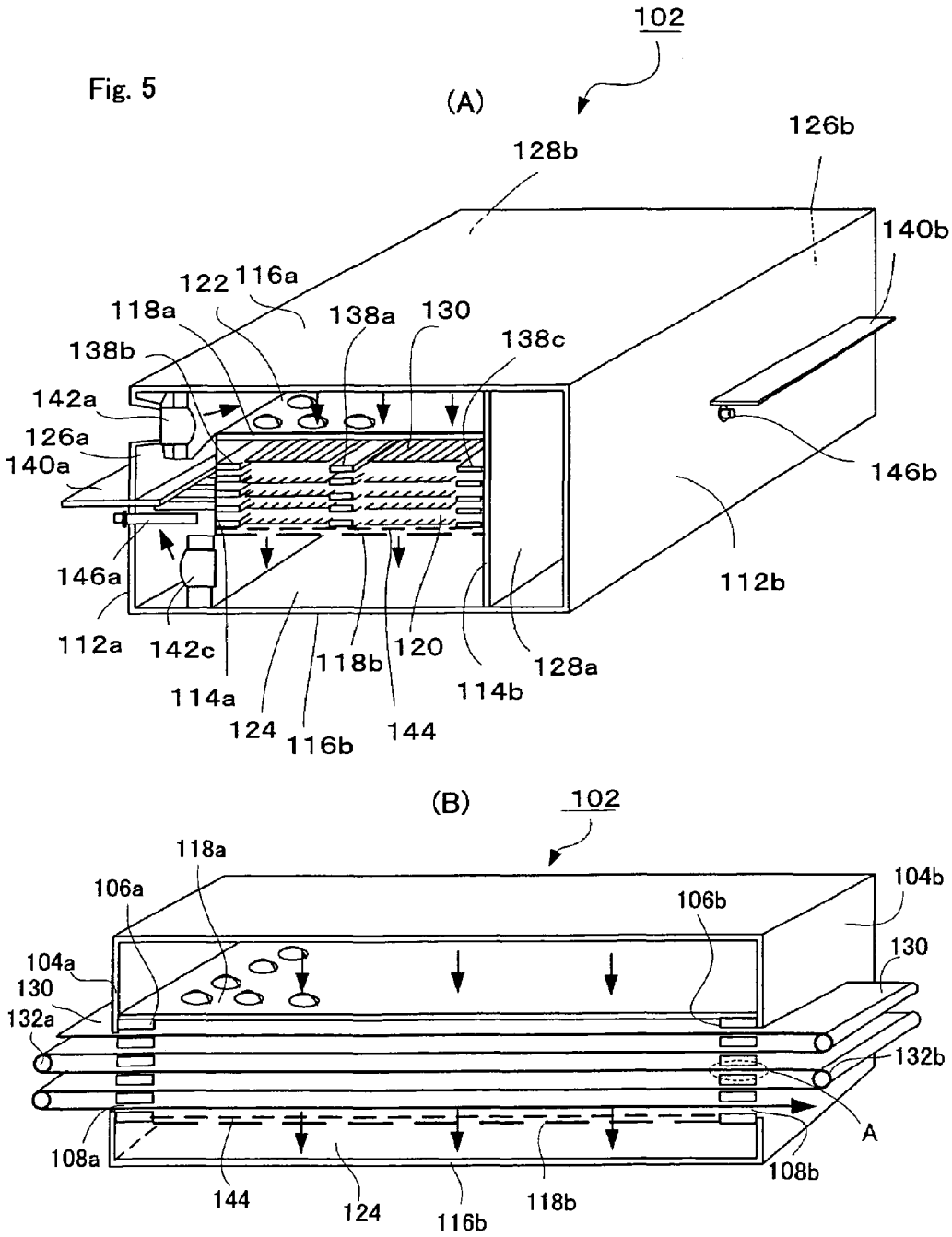
FIG. 5 is a schematic section showing other example of the heat treatment apparatus for oxidation according to the present invention, wherein (A) is a front perspective view and (B) is a side perspective view.
Figure 6:
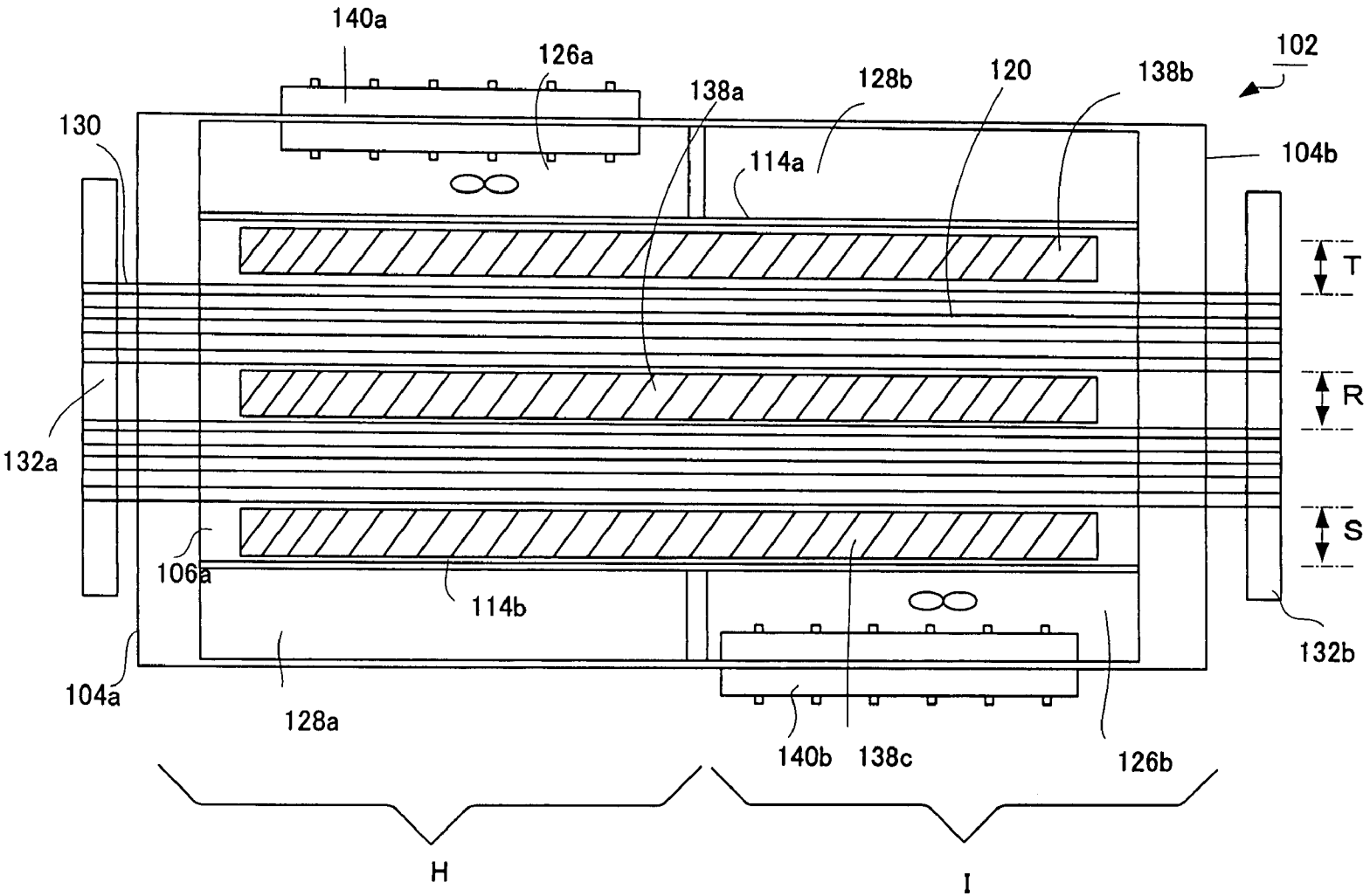
FIG. 6 is a plan section of the apparatus for oxidation shown in FIG. 5.
Figure 7:
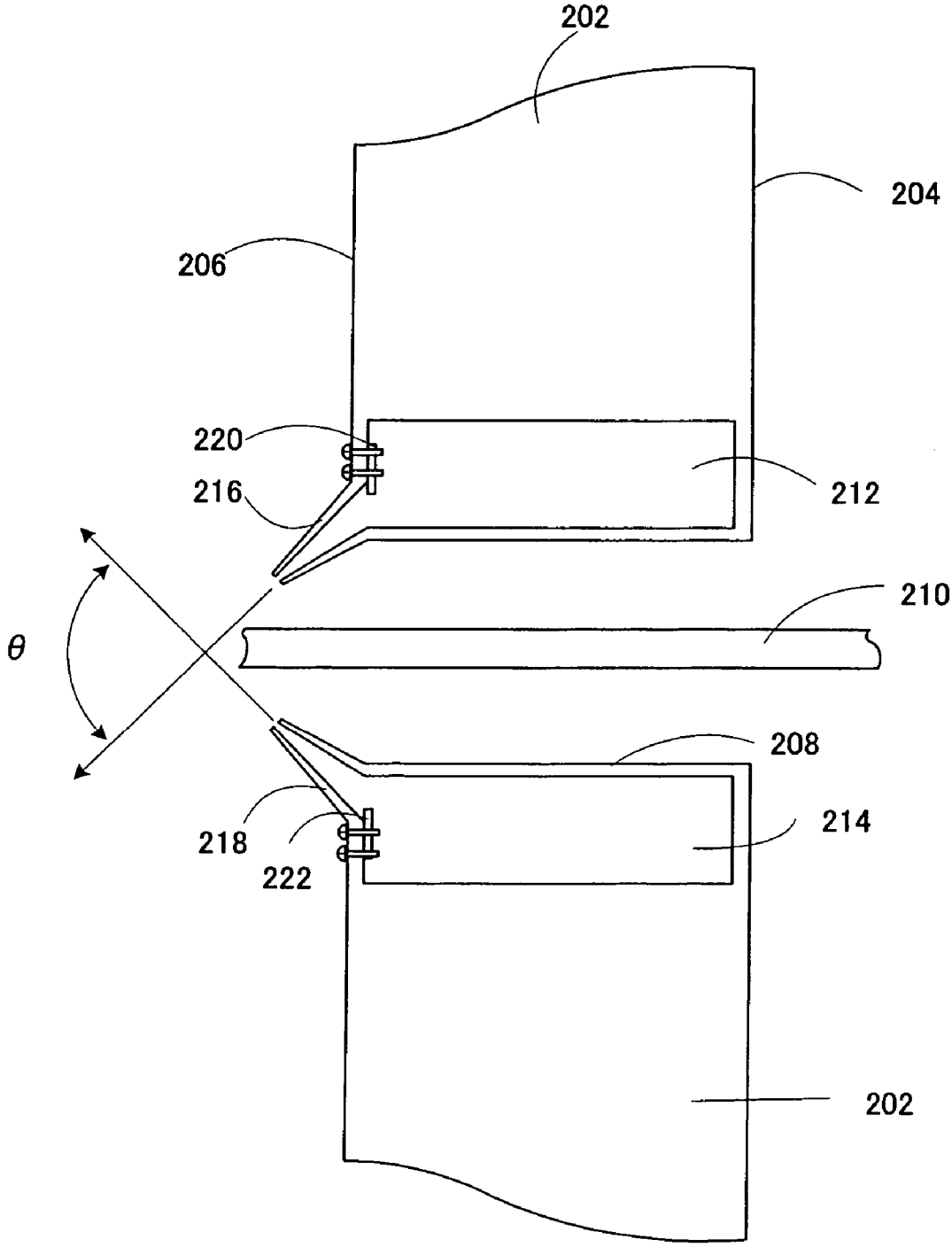
FIG. 7 is an enlarged view of the portion A of FIG. 5(B).

FIG. 5 is a schematic section showing an example of the heat treatment apparatus for oxidation according to the present invention, wherein (A) is a front perspective view and (B) is a side perspective view. FIG. 6 is a plan section of the apparatus of the same apparatus. FIG. 7 is an enlarged view of the portion shown by A of FIG. 5(B). Incidentally, in this example, the indication of direction was made mainly based on FIG. 5(A); the front of the paper surface of FIG. 5 is referred to as "front" and the back of the paper surface is referred to as "back"; and the left, right, upper and lower of the paper surface are referred to as "left", "right", "upper" and "lower", respectively.

In FIG. 5, an oven 102 for oxidation is shown. From the front of the oven 102 for oxidation of FIG. 5(A) toward the back, that is, from the left of FIG. 5(B) toward the right, a front outer wall 104*a*, a front inner wall 106*a*, a back inner wall 106*b*, and a back outer wall 104*b* are provided. In these walls, slits 108*a* are formed being of the same number as that of paths from the front outer wall 104*a* to the front inner wall 106*a*. Also, slits 108*b* are formed by the same number as that of paths from the back outer wall 104*b* to the back inner wall 106*b*.

In the oven 102 for oxidation are formed, in the order of from the left of FIG. 5(A) to the right, a left outer side wall 112*a*, a left inner side wall 14*a*, a right inner side wall 114*b* and a right outer side wall 112*b*.

As shown in FIG. 5(A) and FIG. 5(B), in the oven 102 for oxidation are provided, in the order of from the upper to the lower, an upper outer wall 116*a*, an upper air-passing plate 118*a*, a lower air-passing plate 118*b* and a lower outer wall 116*b*.

A heat treatment chamber 120 is formed by being surrounded by the front inner wall 106*a*, the back inner wall 106*b*, the left inner side wall 114*a*, the right inner side wall 114*b*, the upper air-passing plate 118*a* and the lower air-passing plate 118*b*.

An upper duct 122 is formed above the heat treatment chamber 120, that is, in the area surrounded by the front outer wall 104*a*, the back outer wall 104*b*, the left inner side wall 114*a*, the right inner side wall 114*b*, the upper outer wall 116*a* and the upper air-passing plate 118*a*.

A lower duct 124 is formed below the heat treatment chamber 120, that is, in the area surrounded by the front outer wall 104*a*, the back outer wall 104*b*, the left inner side wall 114*a*, the right inner side wall 114*b*, the lower outer wall 116*b* and the lower air-passing plate 118*b*.

In the front half H (FIG. 6) of the heat treatment chamber 120, outside the left inner side wall 114*a* is provided a hot air circulation duct 126*a* connecting the upper duct 122 and the lower duct 124 both of the heat treatment chamber. Outside the right inner side wall 114*b* is provided a heat-insulating air chamber 128*a*.

The back half I (FIG. 6) of the heat treatment chamber 120 is constituted in contrast to the front half H. That is, outside the right inner side wall 114*b* is provided a hot air circulation duct 126*b* connecting the upper duct 122 and the lower duct 124 both of the heat treatment chamber, and outside the left inner side wall 114*a* is formed a heat-insulating air chamber 128*b*.

In FIG. 5(B), 130 is a polyacrylonitrile-based fiber strands. The strands 130 pass through slits 108*a* formed from the front outer wall 104*a* to the front inner wall 106*a* and through slits 108*b* formed from the back outer wall 104*b* to the back inner wall 106*b*, and leave or enter the heat treatment chamber 120. In the heat treatment chamber 120 run the strands 130 horizontally. The strands 130 are returned by given pairs of returning rollers 132*a* and 132*b* provided outside the oven 102 for oxidation and are fed into the heat treatment chamber 120 in a state of a plurality of paths [five paths in FIG. 5(B)] arranged vertically.

Further, the strands 130 running in a state of paths are divided into a plurality of zones (two zones in FIG. 5) parallel to the running direction. The distance between zones (in FIG. 6, the distance R at the center of strands 130 running in a state of paths) and the distances S and T between inner side wall 114*a* or 114*b* of heat treatment chamber 20 and strands are each 100 mm or more, preferably 150 to 200 mm.

In the present example, in the gaps R, S and T are provided, respectively, channeling-preventing plates 138*a*, 138*b* and 138*c*. The channeling-preventing plates are preferably provided for each path, that is, all paths from path top to path bottom (five paths in this example). By providing the channeling-preventing plates in the gaps R, S and T, the gaps R, S and T are blocked; the gap between fiber strands running in the heat treatment chamber in a state of zones and channeling-preventing plate, or the gap between fiber strands and the channeling-preventing plate interposed between fiber strands and side wall in parallel to the running direction of fiber strands is set at 150 mm or less, preferably at 50 mm or less, more preferably at 5 to 20 mm; and uniformization of the speed of hot air is aimed.

As the channeling-preventing plates 138*a*, 138*b* and 138*c*, there can be used a plate of no air permeability, for example, a plate having no hole. However, in order to make more uniform the distribution of hot air speed in each horizontal path, the channeling-preventing plates 38*a*, 38*b* and 38*c* are preferably a channeling-preventing plate having holes (air permeability), such as a punching plate, a wire net or the like. The channeling-preventing plates preferably have an opening ratio of 60% or less.

The plate of air permeability preferably has a hole diameter of 5 mm or more. By allowing the plate to have a hole diameter of 5 mm or more, the plate is easy to clean and less plugged with fluff of strand.

The heat treatment apparatus for oxidation according to the present invention is provided with a hot air circulation means in each hot air circulation duct, preferably at the top and/or bottom of each hot air circulation duct. For example, as shown in FIG. 5(A), hot air circulation means 142*a* and 142*c* can be provided between the upper duct 124 and the hot air circulation duct 126*a* both of the heat treatment chamber 120 and between the lower duct 120 and the hot air circulation duct 26*a* both of the heat treatment chamber 120.

As the hot air circulation means 142*a* and 142*c*, a fan, a blower or the like can be used. In particular, a multi-blade blower having two hot air inlets is preferred.

By the hot air circulation means 142*c*, hot air is sucked and recovered from the lower duct 124 of the heat treatment chamber 120 into the hot air circulation duct 126*a*. The recovered hot air is sent, by the hot air circulation means 142*a*, from the hot air circulation duct 126*a* toward the upper duct 122 of the heat treatment chamber 120.

As shown in FIGS. 5 and 6, it is possible to provide, in the hot air circulation ducts 126*a* and 126*b*, air speed-controlling members 140*a* and 140*b* capable of controlling the speed of hot air passing through the above hot air circulation ducts.

The air speed-controlling members 140*a* and 140*b* can be exemplified by a damper. By controlling the air flow resistance of the air speed-controlling members 140*a* and 140*b*, for example, the openness of the damper, it is possible to control the speed of sucking and recovering hot air from the lower duct 124 of the heat treatment chamber 120 into the hot air circulation duct 126*a* or 126*b* (not shown) by the above circulation means 142*c*, and the speed of feeding hot air from the hot air circulation duct 126*a* or 126*b* (not shown) into the upper duct 122 of the heat treatment chamber 120 by the hot air circulation means 142*a*.

As described above, by controlling each output of the circulation means 142*a* and 142*c* and each air flow resistance of the air speed-controlling members 140*a* and 140*b*, the speed of the hot air can be controlled so as to be appropriate to the strands of all paths.

It is preferred to provide air-passing members 144 at the bottom of the heat treatment chamber 120 so as to extend in the whole area of the bottom and, below them, lower air-passing plates 118*b* so as to extend in the whole area of the bottom.

The air-passing members 144 are preferably a wire net, a grating or the like all having an opening ratio of 50% or more.

The lower air-passing plates 118*b* are intended to achieve a uniform hot air speed and are preferably a punching board or the like all having a straightening effect.

The air-passing members 144 are provided above the lower air-passing plates 118*b* apart from the plates preferably by at least 20 mm.

The air-passing members 144 prevent cut strands generated during heat treatment for oxidation, from dropping and depositing on the lower air-passing plates 118*b* and blocking the holes of the lower air-passing plates 118*b*.

When there are no air-passing members 144, the cut strands drop and deposit on the lower air-passing plates 118*b*. In this case, the holes of the lower air-passing plates 118*b* are blocked and the speed of hot air decreases locally. It gives rise to heat build-up in strands being subjected to a heat treatment for oxidation, resulting in firing. Provision of the air-passing members 144 is effective for prevention of such heat build-up and firing.

In the heat treatment apparatus for oxidation according to the present invention, it is possible to inject air or hot air into or outside the heat treatment chamber from at least one slit provided in each inner wall or outer wall through which strands pass for entering or leaving the heat treatment chamber.

By injecting hot air from the slit into or outside the heat treatment chamber, it is possible to control the speed of hot air flowing through the paths in the heat treatment chamber, control the temperature of hot air and minimizing the temperature distribution in the paths.

As to the form of injecting hot air from the slit into the heat treatment chamber, hot air may be injected into the heat treatment chamber simply through the slit. Alternatively, a nozzle for injecting hot air may be provided along the slit and hot air may be injected from the nozzle. By injecting hot air from the nozzle, an air curtain is formed in the slit, whereby the air-tightness of the slit is enhanced.

It is also possible that outside air is drawn by the hot air injected from the nozzle and is fed into the heat treatment chamber from the slit in order to supplement the speed of hot air.

An example of the above nozzle is shown in FIG. 7. In FIG. 7, 202 is a heat treatment chamber wall, 204 is an outer wall thereof, and 206 is an inner wall thereof. A slit 208 is formed from the outer wall 204 to the inner wall 206. Through this slit 208, a strand 210 enters and leaves the heat treatment chamber. Above and beneath the slit 208 in the heat treatment chamber wall 202 are provided an upper hot air duct 212 and a lower hot air duct 214. The ducts 212 and 214 are respectively provided with an upper nozzle 216 and a lower nozzle 218 communicating with the above ducts, with the front end of each nozzle directed toward inside the heat treatment chamber. By feeding hot air into the ducts 212 and 214, hot air is injected into the heat treatment chamber from the upper nozzle 216 and the lower nozzle 218. The angles of fixation of the upper nozzle 216 and the lower nozzle 218 are controlled so that the hot airs injected from the nozzles intersect each other. The angle θ of intersection is preferably 60 to 120°.

Incidentally, 220 and 222 are each an air speed-controlling plate. By elevating or lowering the positions thereof, the speed of hot air injecting from the nozzles 216 and 218 can be controlled.

Figure 8:
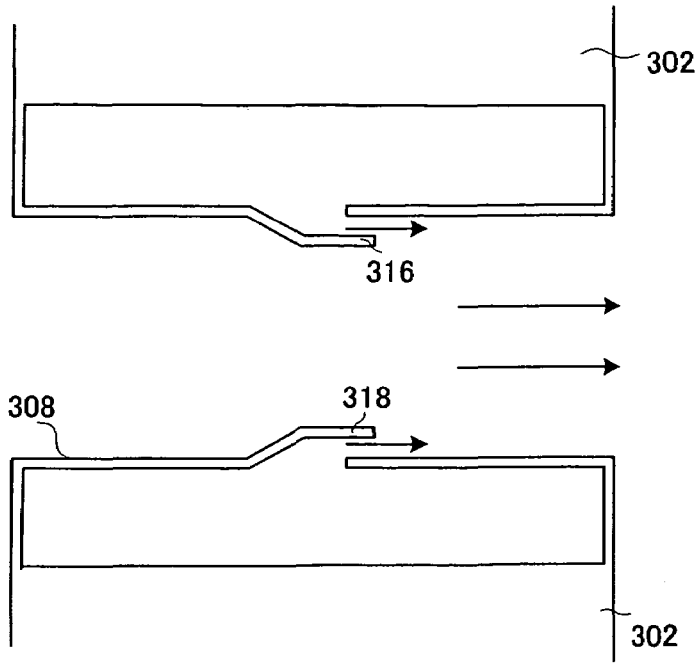
FIG. 8 is a schematic section showing other example of nozzle.
Figure 9:
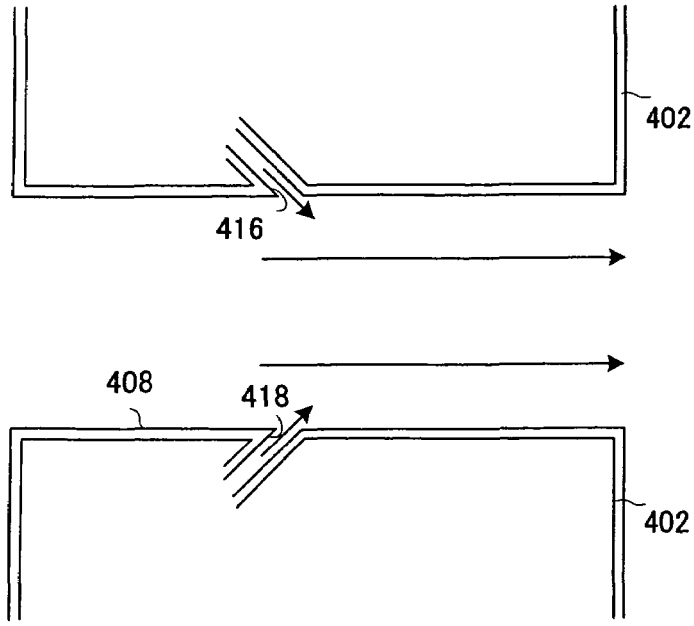
FIG. 9 is a schematic section showing still other example of nozzle.
Figure 10:
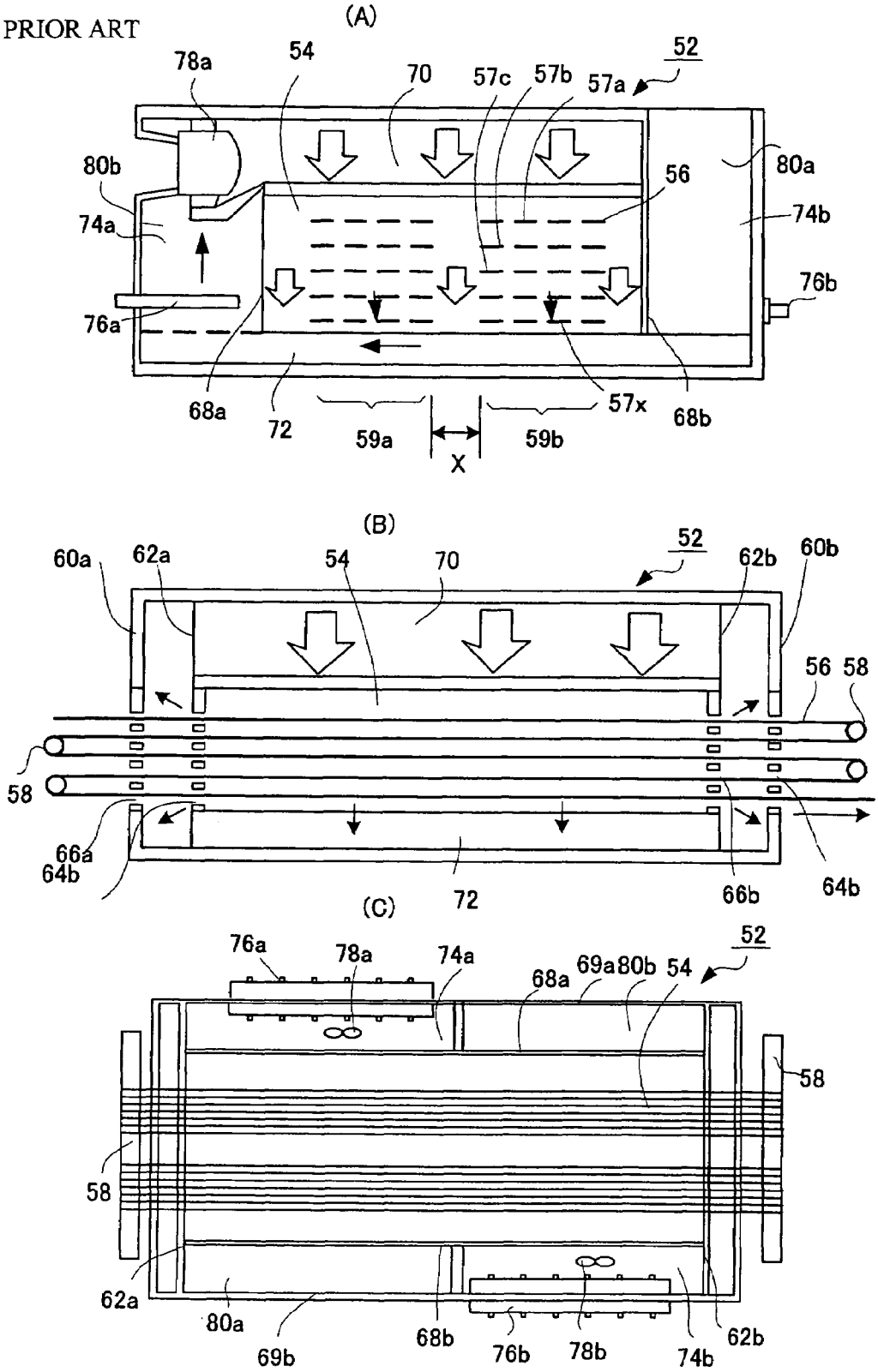
Fig. 10 PRIOR ART
FIG. 10 shows an outline of a conventional heat treatment apparatus for oxidation, wherein (A) is a front section, (B) is a side section and (C) is a plan section.

In FIGS. 8 and 9 are shown other nozzle examples usable in the present invention. In FIGS. 8 and 9, 302 and 402 are each a heat treatment chamber wall; 308 and 408 are each a slit; 316 and 416 are each an upper nozzle; and 318 and 418 are each a lower nozzle.

The nozzles may be fitted to all slits or part of them.

Also, the nozzles may be fitted with the front ends directed toward inside the heat treatment chamber and further with part of the front ends directed toward outside the heat treatment chamber. Part of the hot air passing through the heat treatment chamber is drawn by the air injected from the nozzles whose front ends are directed toward outside the heat treatment chamber, and is discharged outside the heat treatment chamber; thereby, the speed of hot air in the heat treatment chamber can be controlled and penetration of outside air into the heat treatment chamber can be prevented.

The nozzles whose front ends are directed toward outside the heat treatment chamber, are preferably fitted to at least one of the lower slits which correspond to 70% of all the slits. By controlling the speed of air injecting from the nozzles fitted to each slit, it is possible to keep the speed of the hot air passing through the lowermost path, at 20% or more, preferably 30% or more of the speed of the hot air passing through the uppermost path.

It is also possible to provide the nozzles injecting hot air only at the slits of the heat treatment chamber side through which strands enter the heat treatment chamber. In this case, a temperature reduction in the vicinities of these slits can be prevented effectively.

The temperature of the hot air injected from the nozzles is preferably 150 to 300° C. The pressure of the hot air injected is desirably higher than the pressure inside the heat treatment chamber 20 by 10 to 500 Pa.

In the above heat treatment apparatus for oxidation, the slits through which polyacrylonitrile-based fiber strands leave and enter the oven for oxidation are provided with nozzles capable of feeding hot air into the heat treatment chamber. Therefore, leakage of hot air outside from the slits can be prevented effectively, hot air can be fed from the nozzles, and a reduction in hot air speed taking place from upper paths to lower paths can be prevented.

EXAMPLES

Example 1

A heat treatment apparatus for oxidation shown in FIG. 4 was produced. The dimensions of the heat treatment chamber were length=15 m, breadth=2 m, height=1.2 m, upper duct height=0.5 m, and lower duct height=0.3 m. Two returning rollers were provided at each side of the oven for oxidation. A multi-blade fan was provided in each of the upper and lower hot air circulation ducts.

Gaps between zones and between each zone and inner side wall were set at 1 cm. An electric heater was fitted to each side wall.

Into the apparatus were fed polyacrylonitrile-based fiber strands (1 dtex, 24,000 fibers/strand). The feeding speed of strands was 300 m/hr and a hot air of 1.1 m/sec and 260° C. was fed to the uppermost path.

The electricity applied to the side wall heaters was controlled to keep the temperature difference between side wall temperature and heat treatment chamber inside average temperature within 5° C. Thereby, the speed of the hot air passing through intermediate paths could be kept at 70% of the speed of the hot air passing through the uppermost path.

Example 2

A heat treatment apparatus for oxidation shown in FIG. 5 was produced. The dimensions of the heat treatment chamber were length=15 m, breadth=2 m, height=1.2 m, upper duct height=0.5 m, and lower duct height=0.3 m. Two returning rollers were provided at each side of the oven for oxidation. A multi-blade fan was provided at each of the upper and lower hot air circulation ducts.

Five slits were formed in each of the front wall and the back wall. To the slits were fitted nozzles shown in FIG. 7. The injection direction of hot air was toward inside the heat treatment chamber.

Channeling-preventing plates of 15 cm in width were arranged between zones and between zone and inner side wall. Thereby, each gap was set at 1 cm.

Into the apparatus were fed polyacrylonitrile-based fiber strands (1 dtex, 24,000 fibers/strand). The feeding speed of strands was 300 m/hr and a hot air of 1.1 m/sec and 260° C. was fed to the uppermost path.

Hot air of 260° C. was fed to each nozzle at 10 m/sec. Thereby, the speed of the hot air passing through the lowermost path could be kept at 80% of the speed of the hot air passing through the uppermost path.

The invention claimed is:

1. A heat treatment apparatus for oxidation having:

an oven for oxidation having a heat treatment chamber having a plurality of slits through which fiber strands running horizontally leave or returned strands enter and capable of sending hot air vertically from above the fiber strands to allow the fiber strands to have oxidation, and a means for feeding hot air into the heat treatment chamber, a plurality of returning rollers which are provided at the two outsides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and a channeling-preventing plate interposed between the side wall and the fiber strands in parallel to the running direction of fiber strands is set at 150 mm or less and a heating means is provided at the side walls or in the slits and wherein a heating means is provided at said side walls or in said slits.

2. A heat treatment apparatus for oxidation according to claim 1, wherein the channeling-preventing plate has air-passing holes.

3. A heat treatment apparatus for oxidation according to claim 1, wherein the oven for oxidation comprises:

a heat treatment chamber wherein hot air passes from the above toward the bottom, an upper duct formed at the top of the heat treatment chamber, a lower duct formed at the bottom of the heat treatment chamber, and a hot air circulation duct connecting the upper duct and the lower duct.

4. A heat treatment apparatus for oxidation according to claim 3, wherein an air rate-controlling member is provided in the hot air circulation duct.

5. A heat treatment apparatus for oxidation according to claim 3, wherein hot air circulation means are provided at the top and bottom of the hot air circulation duct.

6. A heat treatment apparatus for oxidation according to claim 5, wherein each hot air circulation means is a fan or a blower.

7. A heat treatment apparatus for oxidation according to claim 6, wherein the blower is a multi-blade blower having two inlets for hot air.

8. A heat treatment apparatus for oxidation according to claim 1, wherein air-passing members having an opening ratio of 50% or more are provided above lower air-passing plates provided at the bottom of the heat treatment chamber and apart from the lower air-passing plates by 20 mm or more.

9. A heat treatment apparatus for oxidation according to claim 1, wherein the heating means is a hot air duct formed outside each side wall of the heat treatment chamber.

10. A heat treatment apparatus for oxidation according to claim 1, wherein the heating means is a heater formed each side wall of the heat treatment chamber.

11. A heat treatment apparatus for oxidation according to claim 1, wherein the heating means is nozzles for feeding hot air into the heat treatment chamber, provided in all or part of the plurality of slits.

12. A heat treatment apparatus for oxidation according to claim 11, wherein the hot air has a temperature higher than the temperature of the heat treatment chamber.

13. A heat treatment apparatus for oxidation according to claim 11, wherein the nozzles have a mechanism of feeding, into the heat treatment chamber, not only the hot air injected from the nozzles but also the air present in the vicinity of each nozzle and drawn by said hot air.

14. A heat treatment apparatus for oxidation according to claim 11, wherein the nozzles are provided only in the slits through which each fiber strand enters the heat treatment chamber.

15. A heat treatment apparatus for oxidation according to claim 11, wherein at least one of lower slits corresponding to 70% of the total slits has a nozzle capable of injecting air outside the heat treatment chamber.

16. An operating method of a heat treatment apparatus for oxidation having:

an oven for oxidation having a heat treatment chamber having a plurality of slits through which fiber strands running horizontally leave or returned strands enter and capable of sending hot air vertically from above the fiber strands to allow the fiber strands to have oxidation, and a means for feeding hot air into the heat treatment chamber, and a plurality of returning rollers which are provided at the two sides of the oven for oxidation and which return the fiber strands entering and leaving through said slits, into the oven for oxidation, wherein each gap formed between fiber strands and each side wall of heat treatment chamber parallel to the running direction of fiber strands running in the heat treatment chamber, or each gap formed between fiber strands and channeling-preventing plate interposed between the side wall and the fiber strands in parallel to the running direction of fiber strands is set at 150 mm or less and the plurality of slits are each provided with a nozzle capable of injecting hot air toward the oven for oxidation, in which operating method the speed of the hot air fed from the nozzles is controlled and thereby the speed of the hot air passing through the fiber strands other than the uppermost fiber strands is kept at 20% or more of the speed of the hot air passing through the uppermost fiber strands.

* * * * *